United States Patent [19]

Ament

[11] Patent Number: 4,597,368

[45] Date of Patent: Jul. 1, 1986

[54] ENGINE IDLE SPEED CONTROL SYSTEM

[75] Inventor: Frank Ament, Rochester, Mich.

[73] Assignee: General Motors Corporation, Detroit, Mich.

[21] Appl. No.: 705,143

[22] Filed: Feb. 25, 1985

[51] Int. Cl.[4] ..... F02M 59/20

[52] U.S. Cl. ..... 123/339; 123/357; 123/486

[58] Field of Search ..... 123/339, 340, 357, 358, 123/478, 480, 486

[56] References Cited

U.S. PATENT DOCUMENTS

| | | | |
|---|---|---|---|
| 4,223,654 | 9/1980 | Wessel et al. | 123/358 |
| 4,357,920 | 11/1982 | Stumpp et al. | 123/340 X |
| 4,368,705 | 1/1983 | Stevenson et al. | 123/486 X |
| 4,422,420 | 12/1983 | Cromas et al. | 123/458 X |
| 4,508,075 | 4/1985 | Takao et al. | 123/339 |

*Primary Examiner*—Willis R. Wolfe, Jr.
*Attorney, Agent, or Firm*—Howard N. Conkey

[57] ABSTRACT

An engine idle speed control system is described having an integral adjustment of engine idle speed for maintaining a constant engine idle speed independent of load and having load dependent gain characteristics with the integrator adjustment being a measure of engine load.

2 Claims, 6 Drawing Figures

ENGINE IDLE SPEED CONTROL SYSTEM

This invention relates to an engine idle speed control system and more specifically to an idle speed control system having load dependent gain characteristics.

The idle speed and smoothness of operation of an engine such as a diesel engine is primarily determined by the idle governor characteristics. A typical idle governor is a compromise between the slow response required for a smooth idle and the rapid response necessary to prevent stalling under heavy loading. Since the idle speed must be established at a level high enough to prevent stalling at maximum idle loading, the idle speed is excessively high the remainder of the time. The increased idle speed results in higher fuel consumption, noise and automatic transmission heat dissipation. In order to reduce the speed variation over the idle load range, the idle speed governor would require a high gain versus engine speed resulting in a generally unstable engine operating condition.

Two benefits of electronic fuel injection such as via an electronically controlled diesel injection pump are lower idle speeds and idle speed control. At these low speeds, the faster governor response required to prevent stalling at heavy loads would also cause instability at light loads. The idle speed can be held constant with varying loads by biasing the entire governor curve up or down in an integral fashion. This governor integral bias can be controlled as a function of engine speed error. While this approach can maintain a constant idle speed, the unique governor slope or gain response to engine speed is still a compromise between heavy load stalling and light load stability.

In accord with this invention, the idle governor curve slope or gain versus speed is varied as a function of engine load so that the gain is high at high load conditions to prevent engine stalling and low at low load conditions to provide the slow response for a smooth idle and to maintain idle stability. Additionally, integral control of engine idle speed is provided to maintain a constant desired engine idle speed. The amount of the integrator adjustment is representative of the engine load and is the parameter utilized to determine the governor slope or gain characteristics.

In summary, in accord with this invention the idle governor curve is biased by an integral term to maintain constant idle speed with varying loads while the idle speed governor slope is adjusted in accord with the load represented by the integrator adjustment to provide the necessary governor response for all engine load conditions.

The control of the idle governor slope along with the integrator bias also provides for hot fuel compensation. Because the fuel temperature in a diesel engine has a dramatic effect on injection pump leakage, the fuel delivery curve can vary significantly from the calibrated nominal curve. If the nominal governor curve was tailored for a stable idle at normal operating temperatures, the idle could become rough with hotter or colder fuel at the same engine load. Increased leakage reduces both the fuel quantity and the shape of the governor curve with respect to the actually delivered fuel. Although an idle integrator would bias the entire governor curve to maintain the engine idle speed, a flat governor slope results in a rough idle and possible stalling when the engine is suddenly loaded. By varying the governor slope as a function of the idle integrator as an indicator of engine load, the governor curve represented by the actually delivered fuel would closely approximate the nominal curve.

The load dependent governor of this invention compensates for both changes in engine load and fuel pump calibration. When the idle integrator bias is used as a load dependent input variable, the entire idel governor control function becomes self-compensating.

The invention may be best understood by reference to the following description of a preferred embodiment and the drawings in which.

Figure 1:
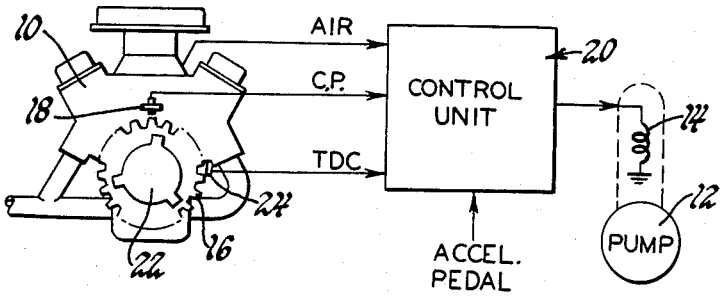
FIG. 1 is an overall schematic diagram of the control system of this invention.

Referring to FIG. 1, the preferred embodiment of this invention is described with respect to a six-cylinder diesel engine 10 having a fuel pump 12 rotated by the engine for injecting fuel to the individual cylinders.

The fuel pump 12 includes a solenoid 14 energized in timed relationship to the engine position so as to control the fuel quantity injected by the pump 12. In this respect, the solenoid winding 14 may be operative to control a spill valve for establishing the injection duration.

The diesel engine 10 includes a ring gear 16 having teeth spaced around its periphery at, for example, 3° intervals. An electromagnetic sensor 18 is positioned to sense the teeth on the ring gear as it is rotated by the engine crankshaft to provide crank position pulses (c.p.) to a control unit 20. The crank position pulses are at a frequency directly proportional to engine speed.

A signal representing the top dead center position of each of the cylinders of the engine 10 is provided by a disc member 22 also rotated by the crankshaft and having teeth spaced at 120° intervals which cooperate with a sensor 24 for providing a top dead center pulse to the control unit 20 at each piston top dead center position.

Additional signals provided to the control unit 20 from the diesel engine 10 include a mass air flow signal provided by a conventional mass air flow sensor in the engine air intake path, and an accelerator pedal position signal. The accelerator pedal position signal represents the position of the operator controlled fuel control element. This signal may be provided by a potentiometer adjusted by the position of the accelerator pedal. The control unit 20 is responsive to the various inputs to control the timed energization of the solenoid winding 14 to in turn control the fuel quantity injected into the engine 10 by the fuel pump 12. The control unit 20, in general, provides for closed loop control of the idle speed of the engine 10 to a desired idle speed by adjusting the fuel injected by the pump 12 in response to the sensed idle speed and further provides for an off-idle fuel quantity in accord with a predetermined stored schedule based on various input operating parameters.

The preferred embodiment of the control unit 20 is a vehicle mounted digital computer which accepts the various input signals and processes them in accord with a predetermined program to energize the solenoid winding 14 so as to provide an established fuel schedule.

Figure 2:
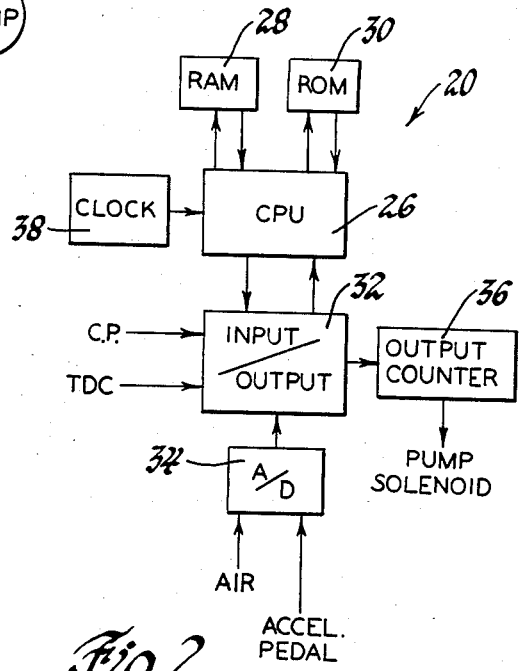
FIG. 2 illustrates a vehicle mounted computer which is a preferred embodiment of the control unit of FIG. 1.

As seen in FIG. 2, the digital computer basically comprises a central processing unit (CPU) 26 which interfaces in the normal manner with a random access memory (RAM) 28, a read-only memory (ROM) 30, an input/output unit 32, an analog-to-digital converter (A/D) 34, an output counter 36 and a clock 38.

In general, the CPU 26 executes an operating program permanently stored in the ROM 30 which also contains lookup tables addressed in accord with the values of selected parameters as will be described in determining the required fuel quantities to be injected into the engine 10. Data is temporarily stored and retrieved from various ROM designated address locations in the RAM 28. Discrete input signals are sensed and the values of analog signals are determined via the input/output circuit 32 which receives directly the position input signals such as the crankshaft position and top dead center signals previously described and the A/D 34 which receives the analog signals from the mass air sensor and accelerator pedal position sensor previously described. The output counter 36 has pulse width values periodically inserted therein in timed relationship to the engine for controlling the solenoid winding 14 to provide the fuel schedules established by the control unit 20.

Figure 4:
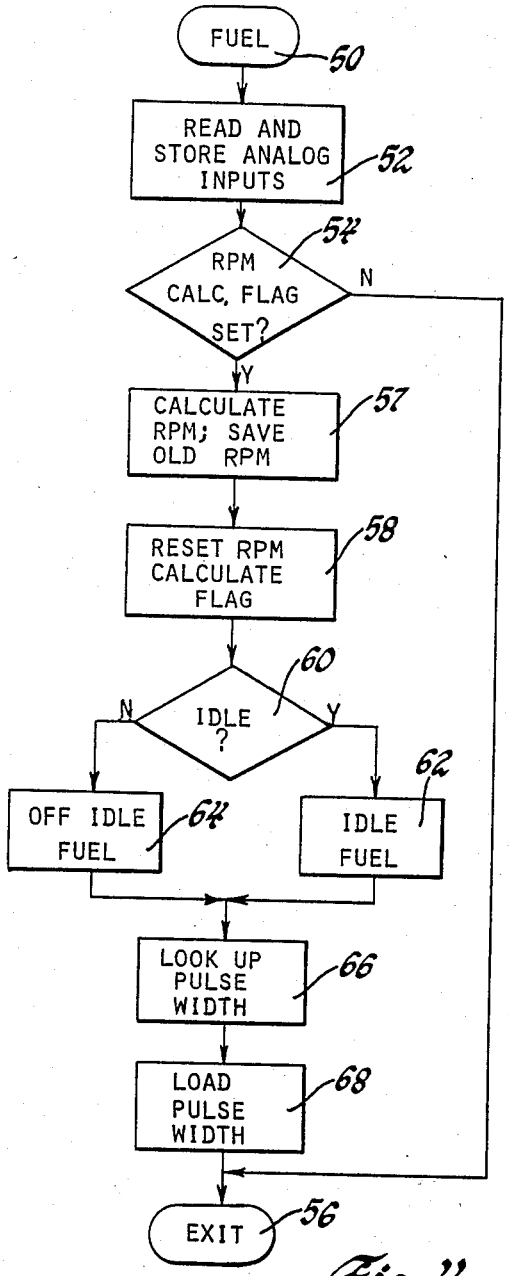
FIGS. 3, 4 and 5 are diagrams illustrative of the operation of the computer of FIG. 2 for controlling the fuel supplied to an internal combustion engine.
Figure 3:
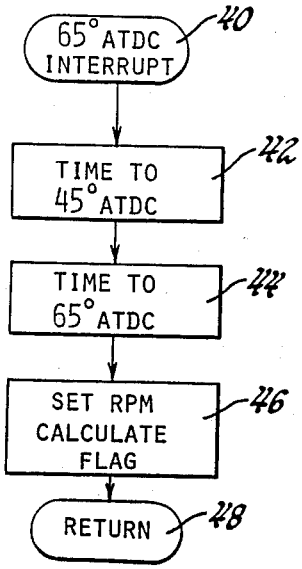
Figure 5:
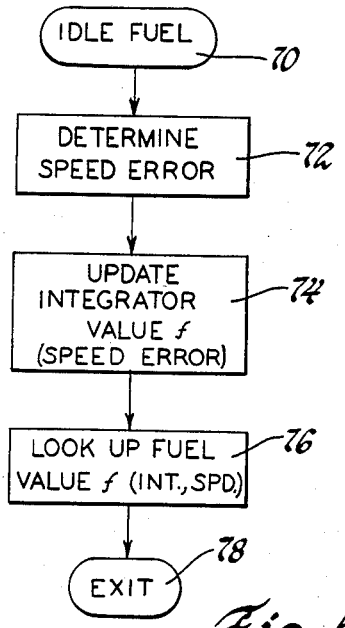

The operation of the digital computer of FIG. 2 in controlling the solenoid winding 14 in response to the various inputs to establish the fuel requirements of the engine are described in FIGS. 3–5. In general, the digital computer executes a main loop routine stored in the ROM 30 at repeated timed intervals. For example, the main loop may be executed at 10 millisecond intervals during which various routines are executed including the fuel control routine of this invention. This routine is illustrated in FIGS. 4 and 5.

While the engine speed may be determined by sensing the frequency of the crankshaft position pulses provided by the sensor 18, in this embodiment, the engine speed is determined by timing the period between two predetermined crankshaft positions. For example, in the preferred embodiment, the speed of the engine is determined just prior to each injection event from the time it takes the crankshaft to rotate between 45° and 65° after top dead center. This time is inversely proportional to engine speed and is utilized as a representation of the engine speed in the fuel control routines.

In determining engine speed, the top dead center pulses generated by the sensor 24 and the crankshaft position pulses generated by the sensor 18 are utilized to generate a 65° after top dead center interrupt input of the CPU 26 which interrupts the main loop previously referred to and executes a routine for establishing engine speed. This speed is illustrated in FIG. 3. Upon receipt of sufficient crankshaft position pulses after the top dead center signal, the CPU 26 interrupts the main loop, enters the 65° after top dead center interrupt routine at step 40 and proceeds to a step 42 where the time required for the engine crankshaft to rotate 45° as measured by a predetermined number of pulses provided by the crankshaft position sensor 18 after receipt of the top dead center signal. The time increment is measured utilizing the clock 38 and is then stored in a ROM designated memory location in the RAM 28. Thereafter at step 44, the time required for the crankshaft to rotate through an angle of 65° after top dead center is determined. This time is also stored in a ROM designated memory location in the RAM 28. Next, the routine proceeds to a step 46 where an rpm calculate flag in the CPU is set. At step 48, the program returns to the main loop.

Returning to FIG. 4, the portion of the main loop which determines and controls the fuel injected by the injection pump 12 is illustrated. This portion of the main loop is entered at step 50 and proceeds to a step 52 where the analog inputs to the A/D 34 are sequentially read and stored in ROM designated memory locations in the RAM 28. Thereafter, the program proceeds to a decision point 54 where the rpm calculate flag in the CPU 26 is sampled. If this flag is in a reset condition indicating that the 65° after top dead center interrupt routine for measuring engine speed has not been executed since the last execution of the main loop, the program exits the fuel control routine portion at step 56. However, if at step 54 it is sensed that the rpm calculate flag is set indicating that the 65° after top dead center interrupt routine of FIG. 3 had been executed during which the rpm calculate flag was set at step 46, the program proceeds to a step 57 where the previously determined time interval values are saved in ROM designated RAM memory locations and a new value of engine speed is calculated based on the difference between the two time intervals determined in the interrupt routine of FIG. 3.

Following the calculation of the new engine speed at step 57, the program proceeds to a step 58 where the rpm calculate flag in the CPU 26 is reset. During subsequent executions of the main loop, the fuel control routine will be bypassed by proceeding from decision point 54 to the exit point 56 until the next 65° after top dead center signal and crankshaft position signals are provided to the control unit 20 at which time the 65° after top dead center interrupt routine of FIG. 3 is again initiated.

From step 58 the program proceeds to a decision point 60 where it is determined whether or not the engine is operating in the idle or off-idle state. This operating state is determined by the condition of the accelerator pedal position read and stored at step 52. If the accelerator pedal position is below a predetermined value indicating the engine is operating at idle, the program proceeds to a step 62 where an idle fuel routine is executed to determine the idle fuel quantity to be injected. As will be described, this routine provides for adjustment of the injected fuel quantity in accord with the principle of this invention to attain a predetermined engine idle speed.

If at decision point 60 it is determined that the accelerator pedal position is representative of an off-idle engine operating condition, the program proceeds to a step 64 where an off-idle fuel routine is executed wherein the off-idle fuel quantities injected by the injection pump 12 are determined.

From each of the steps 62 and 64, the program proceeds to a step 66 where the required pulse width or energization time of the solenoid winding 14 to cause the pump 12 to inject the required fuel amount is determined. This pulse width is obtained from a three-dimensional lookup table in the ROM 30 which contains a schedule of pulse width values selected as a function of the desired fuel quantity and the engine speed. At step 68, the determined pulse width is loaded into the output counter 36 to control the energization of the solenoid winding 14 to provide for the injection of the required amount of fuel to the diesel engine 10 by the injection pump 12.

The idle fuel routine 62 of FIG. 4 for controlling the engine idle speed in accord with the principles of this invention is illustrated in detail in FIG. 5. Referring to this FIGURE, the idle fuel routine is entered at step 70 and proceeds to a step 72 where the engine speed calculated at step 57 of FIG. 4 is compared with a predetermined desired engine idle speed to determine the idle speed error. From step 72, the program next proceeds to step 74 where an integrator value is adjusted in accord with the magnitude and sign of the speed error determined at step 72. The integrator value is increased by an amount based on the magnitude of the speed error when the speed error represents the actual vehicle speed being less than the desired vehicle speed. Conversely, the integrator value is decreased by an amount that is dependent upon the magnitude of the speed error when the speed error represents the actual engine speed being greater than the desired engine idle speed. As will be described, the integrator value obtained from repeated executions of the idle fuel routine results in an adjustment of the fuel quantity injected into the diesel engine 10 in amount and direction to reduce the speed error determined at step 72 to zero thereby causing correspondence between the actual engine idle speed and the desired engine idle speed.

The required quantity of fuel to be injected into the diesel engine 10 for maintaining the desired engine idle speed in response to the integrator value established at step 74 and the establishment of an idle speed governing curve having a slope dependent upon engine load so as to prevent stalling conditions at high engine loads and to provide for operating stability at low engine loads is established by a three-dimensional lookup table stored in the ROM 30. The stored lookup table is diagrammatically illustrated in FIG. 6. In that table, a family of idle speed governor curves are stored as a function of the engine load as represented by the magnitude of the integrator value established at step 74. Each of the individual idle speed governor curves of the family of curves represents idle fuel quantity as a function of engine idle speed for a respective engine load condition. For example, the base governor curve is provided at an integrator adjustment value of 0 which establishes the base governing function tending to establish a desired engine idle speed such as 500 rpm. The slope of the base idle speed governor curve is established by the values stored in the ROM and provides a desired gain in the control of the engine idle speed at the engine load represented by the integrator value adjustment of 0.

Figure 6:
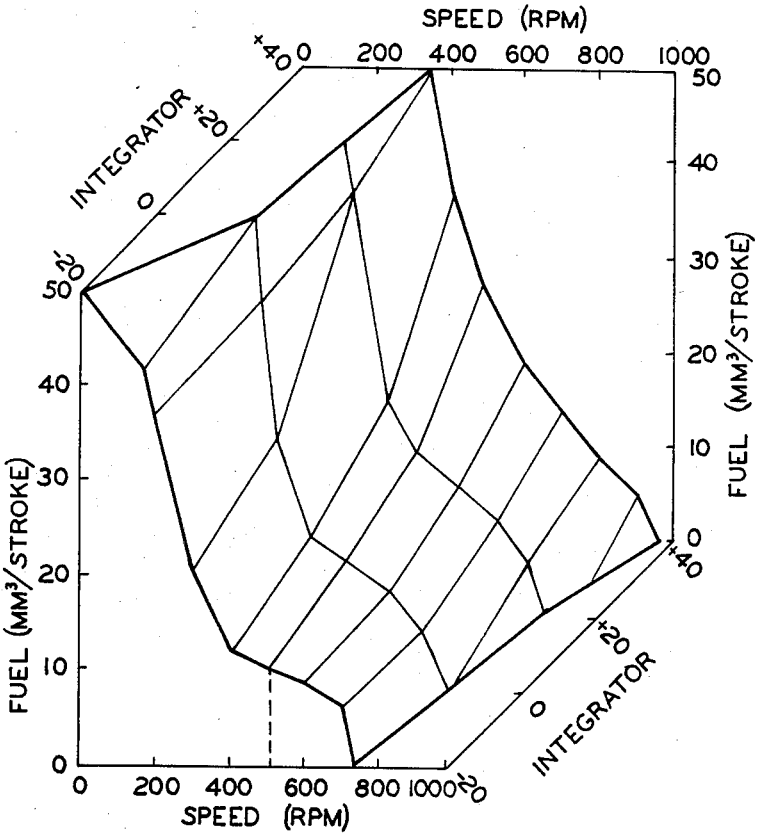
FIG. 6 is a diagram of a three-dimensional lookup table stored in the computer of FIG. 2. for providing the load dependent idle speed governor characteristics in accord with the present invention.

As the integrator value is adjusted in response to errors in the idle speed, the fuel amount is adjusted via the lookup table illustrated in FIG. 6 to reduce the idle speed error to 0. The idle governor curve corresponding to the integrator value when the idle speed error is reduced to zero has the desired gain characteristics corresponding to the engine load condition represented by the integrator value. For example, as the engine load increases, the engine speed tends to decrease. Repeated adjustments of the integrator value through repeated executions of the routine of FIG. 5 reestablishes the idle speed at the desired speed with the integrator adjustment required to establish the engine speed representing the magnitude of the load on the engine. At the new engine load represented by the integrator value, the slope of the governor curve is programmed to provide for a faster response as a function of engine speed so as to prevent engine stall conditions at the high load condition. Conversely, if the load on the engine is reduced, tending to increase the engine idle speed, the integrator value is continually reduced to reduce the fuel via the lookup table of FIG. 6 to reduce the engine speed to the desired engine idle speed. The corresponding idle governor curve in the proximity of the engine idle speed has a smaller slope providing for the desired engine idle speed stability at the lighter engine load condition.

In summary, the lookup table of FIG. 6 implements the desired function of adjusting the scheduled idle fuel quantity in response to the integrator value in direction tending to maintain the desired engine idle speed and further provide for an idle speed governor curve having slopes in the proximity of the desired engine idle speed that increases with increasing loads as measured by the integrator adjustment value and decreases with decreasing engine loads to maintain engine idle stability and for preventing engine stalling conditions.

Returning again to FIG. 5, the program proceeds from the step 74 to the step 76 in which the fuel quantity to be injected into the engine is determined from the lookup table represented by the diagram of FIG. 6 and which is stored in the ROM 30 of FIG. 2 as a function of the integrator value established at 74 and the engine speed determined at step 57 of FIG. 4. By standard interpolation techniques, a large number of governor curves are provided. From step 76, the program exits the idle fuel routine at step 78.

As previously indicated, the fuel quantity estabished by the idle fuel routine is determined and loaded into the output counter 36 at steps 66 and 68 of FIG. 4 to provide the desired fuel injection quantity.

The foregoing system also provides for compensation for the effects of the diesel engine fuel temperature. The increased injection leakage in response to increasing fuel temperatures is seen by the control system described above as an increased load tending to reduce the engine idle speed. In addition, the increased leakage tends to flatten the idle governor slope. The response of the idle fuel routine of FIG. 5 increases the fuel delivered to the engine while at the same time increasing the slope of the governor curve thereby maintaining a stable engine idle condition.

The foregoing description of a preferred embodiment for the purpose of illustrating the invention is not to be considered as limiting or restricting the invention since many modifications may be made by the exercise of skill in the art without departing from the scope of the invention.

The embodiments of the invention in which an exclusive property or privilege is claimed are defined as follows:

1. An idle speed control system for an internal combustion engine having a fuel delivery means for supplying fuel to the engine, the idle speed control system comprising in combination:

means for controlling the fuel delivery means to supply a scheduled idle fuel quantity during an idle operating state of the engine;

means for sensing the engine idle speed;

integrator means responsive to the engine idle speed and a desired engine idle speed for adjusting the scheduled idle fuel quantity in direction and amount to cause correspondence between the engine idle speed and the desired engine idle speed, the integrator means adjustment being a measure of engine load conditions; and means for establishing the scheduled idle fuel quantity, said means including (A) means for establishing a family of curves as a function of the amount of integrator adjustment of the secheduled idle fuel quantity, each curve of the family of curves representing idle fuel quantity as a function of engine idle speed for a respective engine load condition, and (B) means for selecting the curve corresponding to the integrator adjustment of the scheduled idle fuel quantity and providing the scheduled fuel quantity from the selected curve in accord with the sensed engine idle speed.

2. An idle speed control system for an internal combustion engine having a fuel delivery means for supplying fuel to the engine, the idle speed control system comprising in combination:

means for controlling the fuel delivery means to supply a scheduled idle fuel quantity during an idle operating state of the engine;

means for sensing the engine idle speed;

integrator means responsive to the engine idle speed and a desired engine idle speed for adjusting an integrator value in direction and amount to cause correspondence between the engine idle speed and the desired engine idle speed, the integrator means adjustment being a measure of engine load conditions; and means for establishing the scheduled idle fuel quantity, said means including (A) a look-up table having fuel quantity values stored therein as a function of the integrator value and engine speed, the values of fuel quantities stored for each integrator value comprising a governor curve representing the idle fuel quantities as a function of engine idle speed for a respective engine load condition, and (B) means for retrieving the fuel quantity value corresponding to the engine idle speed and the integrator adjustment value, the retrieved fuel quantity value comprising the scheduled idle fuel quantity.

* * * * *